United States Patent [19]

Plant

[11] 4,452,225

[45] Jun. 5, 1984

[54] PORTABLE, AUXILIARY, RADIANT CHIMNEY EFFECT HEATER

[76] Inventor: David F. Plant, 10811 NE. 143, Kirkland, Wash. 98033

[21] Appl. No.: 504,126

[22] Filed: Jun. 14, 1983

[51] Int. Cl.[3] ..... F24C 3/04

[52] U.S. Cl. ..... 126/92 B; 126/213; 431/347

[58] Field of Search ..... 126/92 R, 92 AC, 92 B, 126/27, 4, 6, 39 A, 39 J, 213, 214, 91 R, 59; 431/328, 347, 329

[56] References Cited

U.S. PATENT DOCUMENTS

| | | | |
|---|---|---|---|
| 79,841 | 7/1868 | Lakin | 126/6 |
| 415,730 | 11/1889 | McCoy . | |
| 1,790,644 | 2/1931 | Moreton | 126/92 B |
| 2,255,298 | 9/1941 | Reichhelm | 126/92 B |
| 2,263,432 | 11/1941 | Wood | 126/39 J |
| 2,553,278 | 5/1951 | Rogant | 126/6 |
| 3,140,740 | 7/1964 | Lagreid et al. | 126/6 |
| 3,200,809 | 8/1965 | Suchowolec | 126/92 |
| 3,280,813 | 10/1966 | Schaenzer | 126/4 |
| 3,330,267 | 7/1967 | Bauer | 126/92 |
| 3,364,914 | 1/1968 | Bryan | 126/92 B |
| 3,763,847 | 10/1973 | Guzdar et al. | 126/92 B |
| 3,799,142 | 3/1974 | Jensen | 126/39 J |
| 3,975,140 | 8/1976 | Placek | 431/329 |
| 4,050,442 | 9/1977 | Seiverling | 126/213 |
| 4,354,479 | 10/1982 | Haruhara | 126/92 AC |

FOREIGN PATENT DOCUMENTS

| | | | |
|---|---|---|---|
| 520940 | 5/1940 | United Kingdom | 126/92 B |

*Primary Examiner*—Samuel Scott
*Assistant Examiner*—Margaret A. Focarino
*Attorney, Agent, or Firm*—Quaintance & Murphy

[57] ABSTRACT

An improved, portable, auxiliary radiant chimney effect heater or reradiator including an inverted, conical chimney placed over and heated to the infrared spectrum by an open flame such as that provided by the burner of an otherwise conventional cooking stove. A semi-parabolic reflector surrounds the chimney and the chimney is located at the approximate focal point of the reflector. The invention functions as a chimney, by drawing combustion by-products into the chimney whereupon the chimney is heated and consumes the by-products, particularly noxious fumes and water vapor. The reflector may be provided with a casing and a handle to ease portability of the heater. For the sake of safety, forward, semi-circular guard bars and a rear, guard plate may be provided.

8 Claims, 4 Drawing Figures

PORTABLE, AUXILIARY, RADIANT CHIMNEY EFFECT HEATER

BACKGROUND OF THE INVENTION

This invention relates generally to auxiliary heaters and more particularly to an improved reradiator of the type including an element which glows in the infrared spectrum when a flame is applied to the element and a reflector for directing heat created in the element outwardly from the reflector.

The present invention is particularly useful in confined spaces such as those found in recreational vehicles, campers, house trailers, boat cabins and the like. Additionally, the invention may be employed with conventional fireplaces to greatly improve the heat efficiency of a conventional fireplace and chimney system.

As for the vehicles just discussed or boat cabins, conventional heating systems are provided which are subject to frequent failure or there are no heating systems in place at all. The preferred embodiments of the present invention are adapted to be used with a burner of a cooking stove located in the confined space of campers, trailers or boat cabins and the invention provides an efficient heat source which may be directed as desired while simultaneously eliminating remaining combustion products and water vapor produced by conventional propane gas stoves or the like.

In the particular example of camper vehicles or the like, solutions have been proposed for providing heat from the cooking stove when the separate heating system fails or one is not provided. One solution is to simply light one or more burners of the cooking stove. This solution is unsatisfactory in that conventional burners make poor space heaters because the combustion energy is not directed and thus essentially rises upwardly and the combustion by products condense against the walls and ceilings of the confined space, thus causing a objectional and possibly harmful moisture buildup within the confined space. A second, somewhat satisfactory solution is to place a porous element over the open flame of a stove burner; and inverted flower pot serves the purpose adequately. A clay flower pot will radiate some heat energy and moisture is absorbed. However, a hot clay pot is dangerous to handle and its color temperature is far too low to be reradiated by a reflector element. Additionally, the pot is obviously non-directional; thus heat cannot be directed to any location.

There are several prior U.S. patents which are relevant to the subject matter of this invention. U.S. Pat. No. 3,799,142 issued to F. H. Jensen discloses a catalytic bed heater which may be placed on the burner of an otherwise conventional gas stove. The disclosed invention is useful in confined spaces, such as a boat cabin, house trailer or camper but is not as efficient as the instant invention and the heat produced cannot be directed. U.S. Pat. Nos. 415,730 issued to H. L. McCoy, 2,263,432 issued to F. E. Wood et al and 3,140,740 issued to M. Lagreid et al each disclose a mantle or heater adapted to be placed over an open flame. However, each of these devices is non-directional in nature and actually somewhat less efficient than the inverted flower pot solution above discussed. Another proposed solution is to place a hood over the four burners of a gas stove, the hood having a fan therewithin to direct heat from the burners outwardly into the room or confined space. This invention is disclosed in U.S. Pat. No. 2,553,278 issued to H. R. Rogant. However, this invention does not provide for the elimination of moisture and burning of the remaining combustion products from the open flames of the stove burners.

An alternative solution is to provide a separate heater including a fuel source, a burner for producing a flame, an element heated by the burner to glow in the infrared spectrum and a reflector for directing the heat outwardly in a desired direction. However, such heaters are dedicated to one purpose; thus an existing heat source such as a camper stove could not be utilized. Equally importantly, such devices do not utilize the chimney effect of the instant invention which will be discussed in further detail hereinbelow. Such heaters as just discussed are disclosed in the following U.S. Pat. Nos. 3,200,809 issued to W. T. Suchowolec; 3,330,267 issued to K. E. Bauer; 3,763,847 issued to A. R. Guzdar et al; and 3,975,140 issued to E. W. Placek. A similar, earlier heater is disclosed in U.S. Pat. No. 1,790,644 issued to H. H. Moreton. This heater includes a stand, a reflector having two Bunsen burners therein and a conical heater element arrayed on a horizontal axis, which is brought to incandescence by the burners, there also being a reflector behind the element to direct heat outwardly. However, this patent does not disclose the chimney effect of this invention and the essential heating element is not placed vertically over a burner.

U.S. Pat. No. 4,354,479 issued to T. Haruhara simply discloses and discusses infrared ray generation, particularly the fact that mesh screens are brought to red heat. The prior art does not disclose a reradiator in the form of a portable, auxiliary, augumenting heating device useful with an already available source of heat, such as the burner of an otherwise conventional stove, the heating apparatus including a chimney of inverted conical construction placed over an open flame and heated thereby to the infrared spectrum whereby combustion by-products from the open flame are completely utilized. A semi-parabolic reflector is provided to direct the heat outwardly in any desired direction; for this purpose, the apparatus of the invention may include a handle for appropriate placement of the heating apparatus over the open flame of the stove burner. The radiant chimney is thus an intergal part of the heating system, functioning to consume combustion by products rather than pass them on. Thus, a portable reradiator is provided which serves as a most efficient auxiliary heater for the confined space of a camper or the like, which utilizes a source of heat already present, such as a cooking stove, and eliminates objectionable combustion by-products, particularly noxious fumes and water vapor.

SUMMARY OF THE INVENTION

Accordingly, it is a principal object of the invention to provide a portable, auxiliary, augumenting heating apparatus for use with a source of open flame which functions as a chimney to draw combustion products and heat into the heating apparatus, to heating apparatus including an element which is heated to glow in the infrared spectrum and simultaneously assure completion of combustion of gases drawn into the heating apparatus and elimination of water vapor, the heating apparatus including a reflector, thus to greatly enhance the heating capacity of a cooking stove or the like and efficiently heat a closed space such as the interior of a camper or the like.

It is another object of the invention to provide a portable reradiator capable of directing radiant heat but useful with an already available heat source or open flame, such as that provided by the burner of an otherwise conventional cooking stove.

It is a further object of the invention to provide a portable reradiator having an element heated to the infrared spectrum and a reflector therebehind to direct the infrared heat as desired, the reradiator being useful with any one of the wide variety of otherwise conventional sources of open flame, ranging from a cooking stove burner to a fireplace.

Still another object of the invention is to provide a portable reradiator of safe and simplified construction which is low in cost of manufacture.

Yet a further object of the invention is to provide a portable reradiator which can also be used for cooking purposes, such a toasting, for example.

In general, the present invention is a portable, auxiliary augmenting heating apparatus for use with a source of open flame, the apparatus including an open cylindrical base, dimensioned to be positioned over an open flame and a conical, open mesh, radiant burner of inverted conical construction seated on the base and made of heat resistant material which, when heated, is brought to red heat. Semi-parabolic reflector means partially surround the burner and the burner is located at the approximate focal point of the reflector. A casing may be mounted about the reflector and include a handle for convenience of placement of the heating apparatus on the source of open flame and orientation of the heating apparatus to radiate heat in a desired, particular direction. For safety, guards may be mounted across the face of the heating apparatus, and a guard plate may be provided on the casing, rearwardly of the reflector. The burner of the heating apparatus functions as a chimney, to draw combustion products and heat into the burner from the open flame, the burner then glowing in the infrared spectrum and simultaneously assuring completion of combustion of gases drawn into the burner and elimination of water vapor in the gas, which for example, is a particular problem in the case of propane gas, which is very wet. Thus, a portable reradiator is provided which maximizes the space heating potential of an already available source of heat, such as a cooking stove.

Further novel features and other objects of this invention will become apparent from the following detailed description, discussion and the appended claims taken in conjunction with the accompanying drawings.

BRIEF DESCRIPTION OF THE DRAWINGS

Preferred embodiments of this invention are disclosed in the accompanying drawings in which.

DESCRIPTION OF THE PREFERRED EMBODIMENTS

Figure 2:
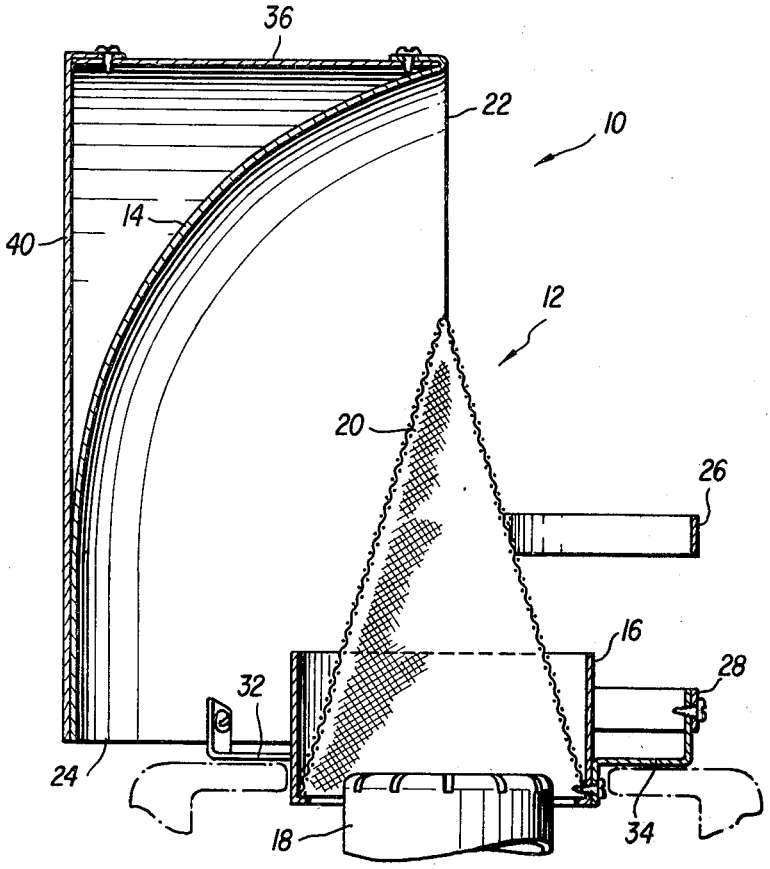
FIG. 2 is a vertical section view, taken through the vertical center of the invention as illustrated in FIG. 1.

Referring now to the figures by reference character, a portable reradiator 10 is illustrated including a central, burner element or chimney 12 and a rearwardly disposed, semi-parabolic reflector 14. The burner element or chimney 12 includes an open, cyclindrical base 16, dimensioned and arranged to be positioned over a source of open flame, such as the otherwise conventional burner 18 of a cooking stove (FIG. 2). A mesh screen 20 of inverted, conical construction is seated within the lower interior of base 16. Mesh screen 20 is made of a heat resistant material which, when heated, is brought to red heat, thus to glow in the infrared spectrum. A preferred material is Monel metal, a readily available alloy comprising 60% to 70% nickel and 25% to 35% copper, with up to 5% of other elements which may include manganese, silicon and carbon. It is has been found that such a material achieves the desired color temperature most adequately.

Reflector 14 is semi-parabolic in construction, terminating in a first curved edge 22 lying generally within a vertical plane and a second curved edge 24 lying generally within a horizontal plane. A pair of semi-circular guards 26, 28 are mounted across the open face of reflector 14. Base 16 of chimney 12 is centrally mounted between the guards 26, 28 and the reflector 14 by a spider assembly, including three equispaced legs 30, 32, connecting base 16 with reflector 14, and leg 34 connecting base 16 with the semi-circular guard 28. The legs 30, 32, 34 are dimensioned so that chimney 12 is located at the approximate focal point of the semi-parabolic reflector 14.

A semi-cyclindrical casing 36 is attached to and surrounds the vertical edge 22 of reflector 14. The casing may include a convenient handle 38 so that the reradiator 10 may be easily moved from place to place, even when hot, without injuring the fingers or hands of the user. As a further safety precaution, a guard plate 40 may be attached to the rear of the casing 36, behind reflector 14, as shown in FIG. 2.

As shown in FIG. 2, base 16 is mounted by legs 30, 32 and 34 so as to depend downwardly from edge 24 of reflector 14 thus to surround stove burner 18, the burner 18 being spaced somewhat from base 16 so that element 12 functions as a chimney. In other words, given the vertical orientation of the components, combustion products from burner 18 are actually drawn upwardly into chimney 12 were further passage is restricted due to the open mesh construction of screen 20. In short order, screen 20 is caused to glow in the infrared spectrum and thus serves as a very efficient source of heat. This heat is then reflected by reflector 14 into the surrounding space to be heated and the direction of heat may be determined by orienting the reradiator 10 as desired upon burner 18, by utilizing handle 38.

Figure 3:
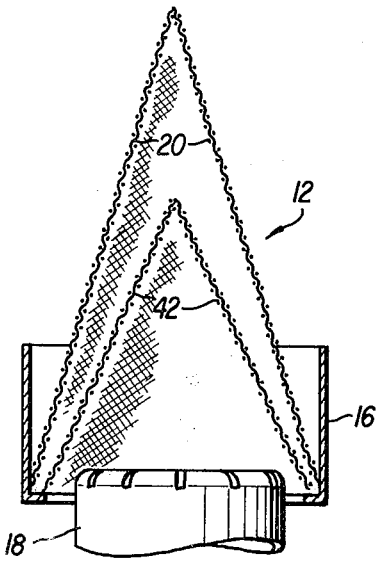
FIG. 3 is a detailed, vertical section view showing another embodiment of the burner or chimney as shown in FIG. 2.
Figure 4:
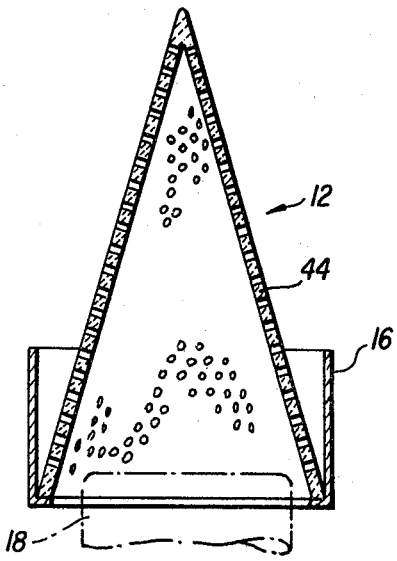
FIG. 4 is a view similar to FIG. 3 showing yet another embodiment of the invention.

Additional embodiments of the burner element or chimney 12 are illustrated in FIGS. 3 and 4. In FIG. 3, chimney 12 includes an additional open mesh screen 42, which may be similar to mesh screen 20 and constructed of the same Monel metal or, if desired, different material. It has been found that the additional conical mesh screen 42 enhances the heat output of the overall apparatus somewhat. In FIG. 4, mesh screen 20 is replaced by a porous, ceramic material screen 44 which also serves the purposes of the invention quite adequately.

It can be seen from the foregoing description that a highly efficient reradiator is provided which is quite uncomplicated in structure. The invention operates according to a radiant chimney effect. In other words, unlike conventional chimneys that pass combustion by-products including heat upwardly and out of the system, the radiant chimney of this invention actually becomes a part of the heating system. The inverted, conical element is positioned so that hot gases have to pass through the chimney as they exit. The chimney soon becomes heated to the infrared spectrum and the undesired by-products of combustion of the gases passing therethrough, particularly noxious fumes and water vapor, are consumed and converted to useful heat.

A further advantage to the invention is that, with slight modifications, the invention can be used in an ordinary fireplace where the invention resists the free flow of combustion by-products into a chimney and thus inhibits the draw of already warmed room air upwardly through the chimney. In a conventional fireplace and chimney system, heated air rising through the chimney from the fireplace serves to create a vacuum in the room being heated and thus actually causes unheated air to enter the room. Clearly, the conventional system is most inefficient. However, with the present invention, draft of warm air through the conventional chimney is inhibited and, additionally, the invention utilizes the combustion by-products rising from the fireplace and creates additional heat for the room.

Figure 1:
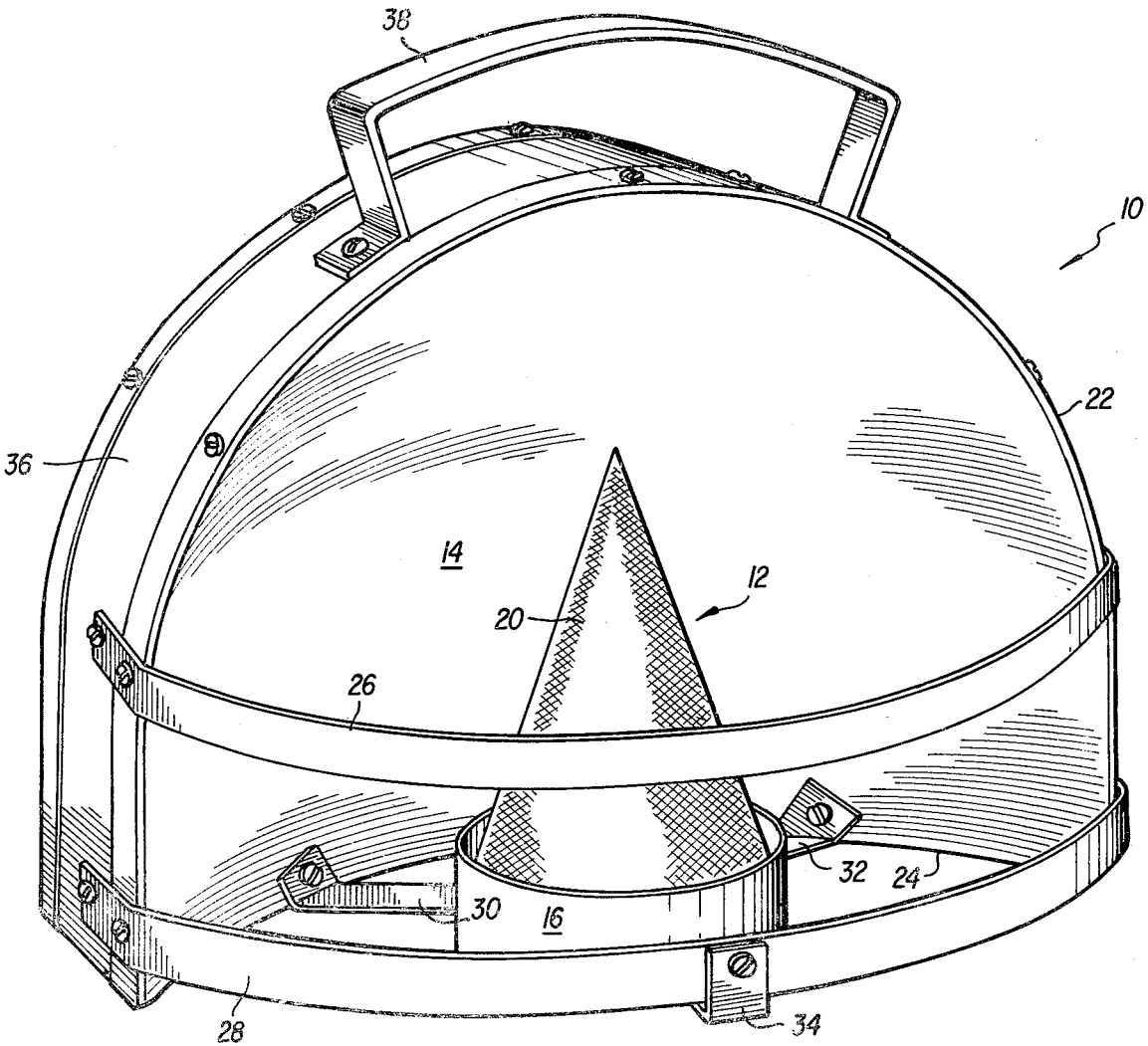
FIG. 1 is a prespective view of the invention.

A further advantage has been found with the invention. It has been found that the embodiments illustrated in the drawings may be used for cooking purposes; bread has been successfully toasted using the embodiment of the invention as illustrated in FIG. 1.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intend to be embraced therein.

What is claimed and desired to be secured by Letters Patent is:

1. A portable, auxiliary augmenting heating apparatus arranged for use with a source of open flame heat such as an otherwise conventional gas stove burner or the like, comprising; an open, cylindrical base, dimensioned and arranged to be positioned over an open flame; a conical, open mesh radiating element mounted on said base and constructed of heat resistant material which, when heated, is brought to red heat; semi-parabolic reflector means partially surrounding said radiating element, said radiating element being located at the approximate focal point of said reflector means, said reflector means terminating in a first curved edge lying generally within a vertical plane and a second curved edge lying generally within a horizontal plane; means for mounting said radiating element within said reflector means at the location as aforesaid; semi-circular guard means mounted on opposed edges of said reflector means and extending across the open side of said reflector means, thus to surround said radiating element; semi-cylindrical casing means attached to said curved edge of said reflector means, thus to house said reflector means; and handle means mounted on said casing means; said heating apparatus, when placed over a source of open flame, thus functioning as a chimney to draw combustion products and heat into said radiating element, said radiating element, upon heating, glowing in the infrared spectrum and simultaneously assuring completion of combustion of the gases drawn to the screen and elimination of condensation of water within a space wherein said heating apparatus is located.

2. The auxiliary heating apparatus as claimed in claim 1 wherein said radiating element is formed as an inverted cone, the base of the cone being seated within the periphery of said open, cylindrical base.

3. The auxiliary heating apparatus as claimed in claim 1 wherein said radiating element is constructed of a metal alloy comprising, principally, 60% to 70% nickel and 25% to 35% copper.

4. The auxiliary heating apparatus as claimed in claim 1 wherein said radiating element further comprises a second conical shell of heat resistant material, interfitted within said concial radiating element.

5. The auxiliary heating apparatus as claimed in claim 1 wherein said radiating element is constructed of a porous, ceramic material.

6. The auxiliary heating apparatus as claimed in claim 1 wherein said means for mounting said radiating element within said reflector means comprise three equispaced legs having inner ends attached to said sylindrical base, the outer ends of two of said legs being attached to said reflector means, the outer end of said third leg being attached to said guard means.

7. The auxiliary heating apparatus as claimed in claim 1 wherein the bottom of said cylindrical base extends below said guard means and said second curved edge of said reflector means, thus to facilitate seating of said base and radiating element directly upon an open flame.

8. The auxiliary heating apparatus as claimed in claim 1 wherein said casing means further comprise guard plate means mounted on a side of said casing means opposite said reflector means.

* * * * *